US005466081A

United States Patent [19]

Schrepf

[11] Patent Number: 5,466,081

[45] Date of Patent: Nov. 14, 1995

[54] MATERIAL APPLICATION WITH EJECTABLE HEAD

[75] Inventor: Volker Schrepf, East Islip, N.Y.

[73] Assignee: Henlopen Manufacturing Co., Inc., Melville, N.Y.

[21] Appl. No.: 241,135

[22] Filed: May 10, 1994

[51] Int. Cl.[6] ..... A45D 40/00; A45D 40/20

[52] U.S. Cl. ..... 401/129; 15/176.1; 132/218; 401/126; 401/290

[58] Field of Search ..... 15/176.1, 176.6; 401/290, 129, 126; 132/218

[56] References Cited

U.S. PATENT DOCUMENTS

| | | | |
|---|---|---|---|
| 571,367 | 11/1896 | Higgins . | |
| 1,886,651 | 5/1930 | De George . | |
| 2,002,752 | 5/1935 | Pahls | 401/129 |
| 2,096,975 | 5/1937 | Revson . | |
| 2,159,914 | 2/1931 | Tweedalf . | |
| 3,502,089 | 10/1967 | Paradis . | |
| 4,605,023 | 8/1986 | Modin . | |
| 4,632,240 | 12/1986 | Goncalves | 401/129 X |
| 4,886,080 | 12/1989 | Cole . | |
| 4,972,858 | 11/1990 | Beck et al. . | |

FOREIGN PATENT DOCUMENTS

| | | | |
|---|---|---|---|
| 1072783 | 9/1954 | France | 401/129 |
| 306962 | 2/1937 | Italy | 15/176.1 |
| 200977 | 11/1938 | Switzerland | 15/176.1 |
| 391185 | 8/1965 | Switzerland | 401/129 |
| 512262 | 8/1939 | United Kingdom | 401/129 |

*Primary Examiner*—Steven A. Bratlie
*Attorney, Agent, or Firm*—Cooper & Dunham

[57] ABSTRACT

An applicator for cosmetics such as mascara, including a handle in the form of a cap for closing the mouth of a cosmetics container and a stem projecting from the cap with a brush or like applicator head at its distal end for insertion in the container, wherein the stem and brush are ejectable from the cap to enable use of the same cap with a succession or variety of brushes. An open-ended retainer socket mounted in the cap receives and releasably engages the proximal end of the stem to secure the stem to the cap, and a manually operable plunger is carried by the cap for engaging the proximal end of the stem in the retainer socket to eject the stem from the cap.

10 Claims, 3 Drawing Sheets

MATERIAL APPLICATION WITH EJECTABLE HEAD

BACKGROUND OF THE INVENTION

This invention relates to hand-held applicators for liquid or pasty materials such as cosmetics, and particularly to applicators of the type having an applicator head carried at the free end of a stem which is secured at its other end to a cap for a container for the material to be applied, the cap serving as the handle for the applicator. Specifically, the invention is directed to such applicators wherein the head and associated stem are separable from the handle or cap to enable replacement of the head or selective use of different heads with the same cap.

The term "material" herein refers to materials that can be picked up by the applicator, as exemplified by substances which are themselves liquid or incorporate a liquid vehicle, e.g. liquid and pasty cosmetic substances such as mascara. In important embodiments, the invention is directed to applicators for liquid or pasty cosmetic materials, especially mascara or the like, to which detailed reference will be made herein for purposes of specific illustration.

A conventional cosmetics dispenser includes a container with an externally threaded neck for receiving an internally threaded container cap. A stem, carrying an applicator head such as a brush, projects from the interior of the cap, which is used as the applicator handle or holder to manipulate the brush or other applicator head. Typically, when the cap is seated on the neck, the applicator head is immersed in the cosmetic material (e.g. mascara) within the container. As the cap is removed from the container, the applicator shaft and head are withdrawn through the neck, transporting a quantity of the cosmetic material for immediate application to the user's face or (in the case of mascara) to the user's eyelashes. The container, though small enough to be carried in the user's pocket or handbag, holds sufficient cosmetic material for multiple applications, the applicator being reinserted in the container as needed to pick up additional material. After a particular applying operation is completed, the cap is retightened on the neck for storage during intervals between successive applications.

Conventionally, the brush or other applicator head is permanently mounted on the stem, which is in turn permanently attached at its proximal end to the cap. However, it would sometimes be desirable to employ replaceable or interchangeable applicator heads with a given cap. For example, mascara brushes are available in a variety of shapes and bristle contents, and different users may wish to use different brushes (or one user may wish to use different brushes at different times) with a particular mascara product. Since mascara dispenser caps are relatively expensive articles, decoratively finished or adorned to contribute to a distinctive overall aesthetic design of the dispenser, it would be advantageous from the standpoint of economy and convenience to enable ready interchange of brushes on one cap.

It is also frequent retail practice to offer shoppers an opportunity to make test applications of cosmetics such as mascara at the point of purchase. Use of the same brush or other applicator by plural customers presents a potential hygiene problem in that infections may be transmitted from user to the next; moreover, fear of such contamination may deter customers from testing cosmetics available for test application only with a common applicator. These concerns can be avoided by supplying an individual disposable or recyclable test applicator for each customer, but it would be costly to provide each disposable applicator with its own handle simulating the heft and feel of a conventional dispenser cap, as desired to render test application conditions as attractive and familiar as possible.

Cosmetic and like applicators heretofore available have not afforded satisfactory solutions to these problems. Some known material dispensers, as shown for example in U.S. Pat. Nos. 571,367, 1,886,651 and 2,096,975, have container caps formed with a threaded or friction-fit socket for mounting a stem carrying a brush. However, insofar as the brushes of these devices may be inherently removable from their associated caps after use for replacement with another brush, such removal would involve grasping the used brush or its stem to unscrew or pull the stem from the socket, with resultant soiling of the hands by residual dispensed material on the brush or stem.

It is known, as well, to provide a single cosmetics dispenser with plural brushes and/or other heads each having its own handle or cap, as shown for example in U.S. Pat. Nos. 4,886,080 and 4,972,858, thereby to afford the user a choice of heads of differing characteristics. Such arrangements, however, tend to increase the size of a dispenser (for a given quantity of contained cosmetic material), i.e. to accommodate the plural heads, and are limited as to the number of different heads available for the user's choice. In addition, the provision of a separate handle or cap for each brush adds to the cost of the dispenser.

SUMMARY OF THE INVENTION

The present invention broadly contemplates the provision of a hand-held applicator for liquid or pasty material, including a handle dimensioned to be grasped by the fingers of a user's hand; a stem having a proximal end and a distal end, mountable in the handle such that the distal end extends therefrom; and an applicator head carried by the stem at the distal end thereof; wherein the improvement comprises retaining means mounted in the handle for engaging a proximal end portion of the stem to releasably secure the stem to the handle, the proximal end portion and the retaining means being mutually shaped and dimensioned to enable insertion of the proximal end of the stem into the retaining means and disengagement of the stem from the retaining means by force exerted on the proximal end of the stem in a direction toward the distal end of the stem; and manually operable plunger means carried by the handle for engaging and exerting the aforesaid force on the proximal end of the stem, when the proximal end of the stem is engaged by the retaining means, to eject the stem from the handle.

Further in accordance with the invention, the plunger means is movable between a first position for accommodating engagement of the stem proximal end by the retaining means and a second position to which the plunger means is moved in ejecting the stem from the handle, the plunger means being movable from its second position to its first position by manual insertion of the stem proximal end into the retaining means and being movable from the first position to the second position by manual force exerted on the plunger means.

Advantageously, in important and preferred embodiments of the invention, the handle is an internally threaded cap for seating on an externally threaded neck of a cosmetics container to close the container, the applicator head is a head for picking up, conveying and applying to a user's face a liquid or pasty cosmetic material enclosed within the container, and at least the proximal portion of the stem is coaxial with the internally threaded cap. The head can be a mascara brush.

Typically or preferably, as a still further feature of the invention, the cap has a skirt and the plunger means comprises a top portion of the cap, movable relative to the skirt in opposite directions axially of the skirt, and a plunger projection extending from the top portion into the interior of the cap coaxially therewith, the cap top portion and skirt cooperating to limit movement of the plunger means relative to the skirt between the aforesaid first and second positions. In one such embodiment the stem proximal end has an annular circumferential groove and the retaining means comprises a resilient socket mounted within the cap and releasably engageable with the groove. In another such embodiment the retaining means comprises an open-ended hollow or tubular shaft, the plunger projection being inserted within the shaft, and the shaft having a distal end for receiving and frictionally engaging the proximal end portion of the stem.

The applicator of the invention may be employed with a generally conventional container, e.g. a mascara or other cosmetic material container, having a neck on which the applicator handle or cap seats. As thus used, it enables interchangeable mounting of different brushes or other applicators in the same cap. For instance, a purchaser may buy a mascara dispenser including a filled container of mascara and a cap of the applicator of the invention, and at the same time may separately choose a desired mascara brush (from a selection of brushes having different features or characteristics) to be mounted in the cap. Both initial insertion and subsequent removal of the brush are readily performed by simple manipulations, the removal of the brush being effected by pressing the external surface of the plunger top portion of the cap without risk of soiling the fingers by residual mascara on the removed brush or stem. In the same manner, a purchaser may buy a selection or set of different brushes for interchangeable use with the same dispenser cap.

Another particular environment of use of the invention is in point-of-purchase test application of mascara or other cosmetics. For such use, a succession of disposable brushes (one for each customer) are used in turn with the same cap or handle, again with advantageous manipulative ease and freedom from soiling of fingers in removing and replacing the brushes. In this way, the hygiene problems of point-of-purchase testing are fully avoided. The handle or cap may be identical to that on the dispensers of the product being sold, thereby promoting product identification with the sample, and also imparting the feel of the handle with which the customer is familiar in applying such cosmetics, yet the cost of the disposable elements is minimal because the relatively expensive handle or cap (which is not vulnerable to contamination or transmission of infections) is re-used for successive tests.

In specific embodiments of the invention for point-of-purchase testing, the applicator also includes a removable shield enclosing the brush for hygienic reasons and/or to confine a sample quantity of the cosmetic material deposited in the shield or preloaded on the brush.

Further features and advantages of the invention will be apparent from the detailed description hereinbelow set forth, together with the accompanying drawings.

DETAILED DESCRIPTION

Figure 1:
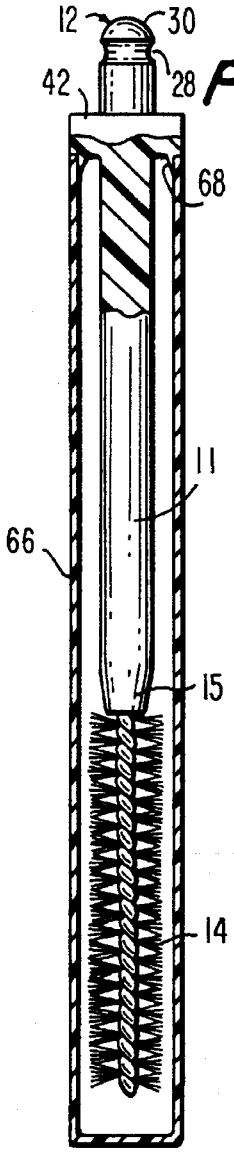
FIG. 1 is a longitudinal sectional view of the head and stem of a mascara applicator embodying the present invention in a particular form, showing the head and stem enclosed in a shield, prior to assembly with the cap, retaining means and plunger means of the applicator.

The invention will be described, with reference to the drawings, as embodied in applicators and dispensers for mascara, but it will be appreciated that the invention in its broader aspects may be embodied in applicators for other liquid or pasty cosmetic materials as well, or indeed for liquid or pasty materials other than cosmetics, with which such applicators may be used.

In common with known mascara applicators, the applicator of the embodiment of the invention shown in FIGS. 1–4 and 8 includes an applicator handle in the form of a container cap 10, a rigid and axially rectilinear stem 11 mounted at its proximal end 12 in the cap, and an applicator head consisting of a conventional twisted-in-wire mascara brush 14 fixedly anchored in and extending from the distal end 15 of the stem. The cap 10 has an internally threaded skirt 16 coaxially surrounding the stem, which projects through and beyond the open end of the skirt so that the brush is exposed for pickup and application of mascara. The various elements of the applicator other than the brush can be fabricated of plastic and/or metal, molded or formed in known ways heretofore employed in the manufacture of mascara applicators.

The threaded skirt of the cap is arranged and dimensioned to engage the thread of, and seat on, an externally threaded neck 18 of a conventional mascara container 20 (FIG. 8) to close the mouth of the container, with the brush extending into the container interior for immersion in a body 22 of mascara therein. Typically, the container is an elongated (and, e.g., cylindrical) molded plastic or formed metal vessel holding sufficient mascara for repeated applications, but small enough to fit in a user's pocket or handbag. The container and applicator together constitute a mascara dispenser that can be used in a conventional manner to apply mascara, viz., by unscrewing and removing the cap from the container neck to convey the brush (loaded with mascara from body 22) into contact with the user's eyelashes, the cap serving as a handle.

As a particular feature of the invention, and in contrast to prior mascara dispensers, the brush-carrying stem 11 is not permanently anchored in the cap 10, but instead is manually insertable in and ejectable from the cap so as to be replaceable with other stems bearing new and/or different brushes, i.e., to enable repeated changes of brushes while employing the same cap as a handle. To this end, the means for mounting or retaining the stem in the cap of the applicator of FIGS. 1–4 and 8 comprises an open-ended socket 24 mounted within the cap 10 for engaging the proximal end portion 12 of the stem 11 to releasably secure the stem to the cap. As hereinafter further explained, the socket 24 and the proximal end portion 12 of the stem are mutually shaped and dimensioned to enable the proximal end of the stem to be inserted into the socket and, after such insertion, to be disengaged from the socket by force exerted on the proximal stem end in a direction (along the stem axis) toward the distal end 15, such direction being indicated by arrow P in FIG. 4. In addition, the applicator includes manually operable plunger means 26 carried by the cap 10 for engaging (and exerting the just-mentioned force on) the stem proximal end 12, when that stem end is engaged by the socket 24, to eject the stem and its associated brush from the cap.

Figure 2:
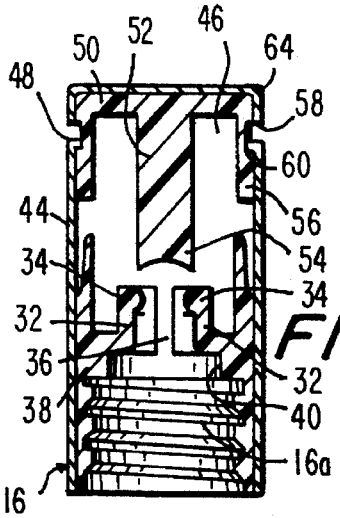
FIG. 2 is a longitudinal sectional view of the cap, retaining means and plunger means of the same applicator, prior to assembly with the head and stem of FIG. 1.

In the specific embodiment of FIGS. 1–4 and 8, the proximal end portion of the stem is a cylindrical shank formed with a rounded circumferential annular indentation or groove 28 and terminates, proximally of the groove, in a convexly rounded extremity 30 (FIG. 1). The socket 24 is constituted of a pair of facing, spaced-apart, stiffly resiliently deformable short legs 32 disposed within the cap skirt on opposite sides of the skirt axis and extending therealong to terminate in proximal free ends 34 which are inwardly enlarged or bead-shaped (FIG. 2). The facing surfaces of these legs define a passage 36, open at both ends and coaxial with the skirt, into which the proximal end portion of the stem 11 may be inserted (from the distal end of the passage, i.e., in the direction opposite to that of arrow P in FIG. 4) until the bead-shaped free ends 34 of the legs are received in the stem groove 28. The resilient deformability of the legs is sufficient so that they spread apart to accommodate such insertion when the stem is pushed manually upward into the cap, and, when the groove 28 reaches the beaded ends 34, they snap back to grip and stably retain the stem in the cap in the position shown in FIGS. 3 and 8. The engagement of the beaded ends 34 with the groove 28 holds the stem against axially directed displacement relative to the cap, while the facing sides of the legs, engaging the stem just distally of the groove, retain the stem against lateral displacement. After the stem has been thus seated in the socket, exertion of pressure on the proximal extremity 30 of the stem in a distal direction (arrow P, FIG. 4) again forces the resilient legs 32 apart to permit distally directed movement of the stem out of the socket, ejecting the stem from the cap. The rounding of the proximal end portion surfaces of the stem facilitates such insertion and ejection.

Figure 3:
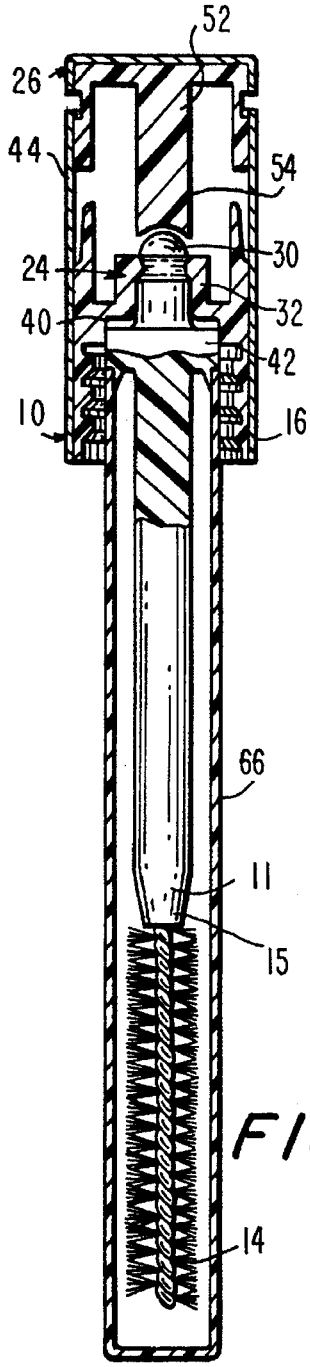
FIG. 3 is a longitudinal sectional view of the same applicator with the elements of FIGS. 1 and 2 assembled together.
Figure 8:
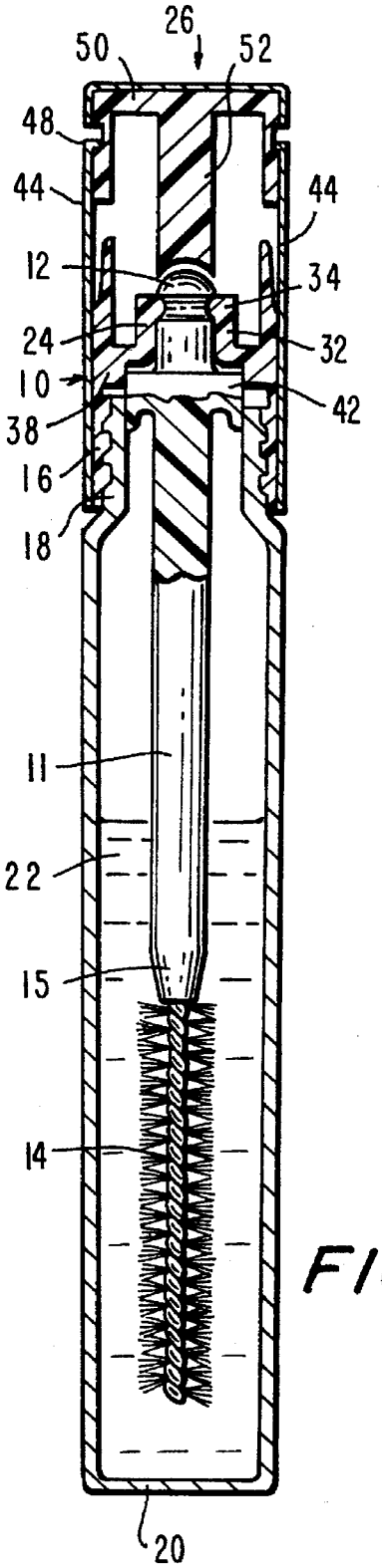
FIG. 8 is a longitudinal sectional view of the applicator of FIGS. 1–4 in use as a cap closing the neck of the container of a mascara dispenser.

As shown (FIG. 1), the legs 32 may be molded or formed integrally with a plastic sleeve 38 constituting the body of the cap skirt 16 and bearing the internal thread **16*a* that mates with the external thread of the container neck. Between the thread 16*a* and the passage 36, the sleeve 38 defines a shallow cylindrical recess 40, opening in the distal direction and having a diameter larger than that of passage 36 but smaller than the internal diameter of the threaded portion of the skirt. This recess, which is coaxial with the skirt, receives an enlarged circumferential annular flange 42 formed on and integrally with the proximal end portion of the stem 11 at a location spaced distally from groove 28, as shown in FIGS. 3 and 8, when the proximal end of the stem is fully inserted in the socket 24. The engagement of flange 42 with the wall of recess 40 both contributes to the positional stabilization of the stem relative to the cap and prevents mascara from entering and contaminating the interior of the cap inwardly (i.e. proximally) of the socket. The sleeve 38 advantageously is of such resilience as to provide a seal with the container neck 18 and with the flange 42**, thereby to afford desirably tight and complete closure of the container.

A rigid outer sleeve 44, conveniently or preferably formed of metal and open at both ends, coaxially surrounds the socket-bearing sleeve 38 (being suitably bonded or adhered thereto) and extends for some distance proximally therefrom to define an interior space 46. At its upper or proximal end, sleeve 44 is turned inwardly around its entire periphery to provide an annular stop bead or flange 48.

The plunger means 26 of the applicator of FIGS. 1–4 and 8 extends within the space 46, and includes a disk-shaped top portion 50 of the cap, from which a plunger rod 52 projects (coaxially with the cap) in a distal direction through space 46 toward the open proximal end of the socket passage 36, terminating distally in a concave end 54 for engaging the convex proximal extremity 30 of the stem 11 when the proximal end of the stem is seated in the socket 24. The plunger means also includes an annular side wall 56 (coaxial with the cap), extending distally from the periphery of disk 50 into the space 46 in continuous slidable engagement with the inner surface of the metal sleeve 44, and formed with an inwardly offset portion adjacent the disk 50 to define axially spaced shoulders 58 and 60 respectively engageable with the upwardly and downwardly (proximally and distally) facing sides of the stop flange 48. The disk 50, rod 52 and side wall 56 may, for example, be formed as a single, integral molded plastic body constituting the plunger means 26, and the exterior of the disk 50 may be covered with a metal jacket 64 conforming in appearance to the metal sleeve 44. It will be seen that the disk and side wall of the plunger element cooperate with sleeve 44 to fully enclose the interior space 46 at all times, regardless of the position of the plunger.

Figure 4:
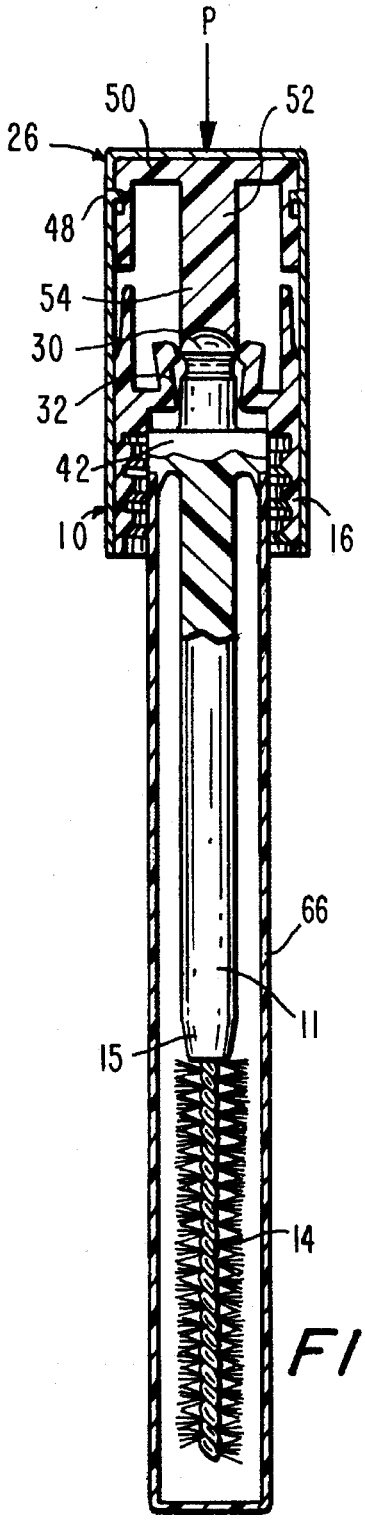
FIG. 4 is another similar view of the same applicator showing the stem and head being ejected from the retaining means by the plunger means.

As mounted, the plunger means 26 is held against axial displacement by the continuous engagement of wall 56 with sleeve 44 but has a limited range of displacement in the axial direction, viz. between the first or proximal limiting position illustrated in FIG. 3 and the second or distal limiting position illustrated in FIG. 4, the limits of this range being respectively established by engagement of the shoulders 58 and 60 with the stop flange 48. When the plunger is in the first (FIG. 3) position, it accommodates full insertion of the proximal end 12 of the stem 11 into the socket 24. When the plunger is moved to the second (FIG. 4) position, by manual (finger) pressure exerted on the outer surface of disk 50 in direction P, the concave distal end of the plunger rod engages and pushes the proximal extremity 30 of a stem 11 previously inserted in socket 24 so as to eject the stem from the socket. If the plunger happens to be in the latter position when the next stem is inserted in the socket, the proximal extremity of the stem simply pushes the plunger rod up (in a proximal direction) and out of the way, viz., back to the FIG. 3 position. No spring or other biasing means is required to act on the plunger in either direction.

The operation of the applicator of FIGS. 1–4 and 8, for insertion and replacement of stems and brushes, may now be readily understood. With the cap not holding any stem and brush, and removed from the container neck 18, the proximal end portion 12 of a brush-bearing stem 11 (FIG. 2) is manually inserted into the interior of the cap skirt 16 (FIG. 1), until the stem proximal end seats fully in the socket 24

(FIG. 3). The inserting operation inherently lifts the plunger to the FIG. 3 position if the plunger is not already at that position. The stem, bearing the brush, is now fully and stably anchored in the cap, and is ready for use to apply mascara.

Thereafter, to remove the stem and brush, the plunger body 26 is simply depressed by finger pressure exerted on disk 50 in direction P (FIG. 4). This forces the plunger to its second position and pushes the proximal end of the stem out of the socket, ejecting the stem and cap. Another stem, bearing a fresh or different brush, may then be inserted in the cap for use of the cap as a handle for that brush.

The applicator of the invention enables mascara dispensers to be sold to end users with a selection of brushes having different characteristics. Thus, at the point of sale, the customer may be offered the choice of any one of a variety of brushes (with attached stems 11) for the cap and container she buys, and may install the selected brush either in the store or after purchase. Alternatively, a mascara dispenser may be sold with a set of brushes differing in such respects as size, shape, bristle properties and/or density, etc.

The applicator also facilitates low-cost provision and maintenance of fully hygienic conditions in point-of-sale test applications, i.e., in situations where prospective purchasers are offered the opportunity to make test applications of mascaras before choosing and buying a particular product. That is to say, successive disposable brush-bearing stems may be used, one for each customer, with the same cap, thereby avoiding any possibility of transmitting contamination or infection on the applicator from one customer to another.

For the latter use, it is desirable to enclose each stem-brush unit with a disposable shield, e.g. a thin transparent plastic shield 66 as shown in FIGS. 1, 3 and 4. The shield 66 has a closed distal end and an open proximal end that engages the stem flange 42. A small depending annular lip 68 may be formed on the distal side of the flange 42 to secure the shield thereto, either by friction fit or by light and manually disruptable adhesion.

The shield 66 prevents contamination of the brush 14 prior to use. In addition, if desired, the brush may be preloaded with a sample quantity of mascara to be tested, or a sample quantity of a liquid cosmetic may be deposited within the shield for pickup by the brush, the sample quantity being protected by the shield. The shield may be removed manually, either before or after the stem 11 is inserted in the cap 10, before the brush is used. Ordinarily, the shield is removed (and the brush is used) before the stem and brush are ejected, although ejection can be accomplished with the shield still in place (or replaced, for convenience of disposal) as shown in FIG. 4.

In all the described uses, ejection and replacement of brushes can be accomplished by simple and easy manipulations without risk of soiling the fingers because a used brush can be ejected without being touched at all (i.e., by merely pushing on the plunger while holding the cap skirt over a waste receptacle). Thus, a new unloaded brush cannot soil the fingers and a preloaded sample-test brush can be inserted with its protective shield in place. Corresponding advantages can be realized in embodiments of the invention for applying cosmetics other than mascara, or liquid or pasty materials other than cosmetics.

Figure 5:
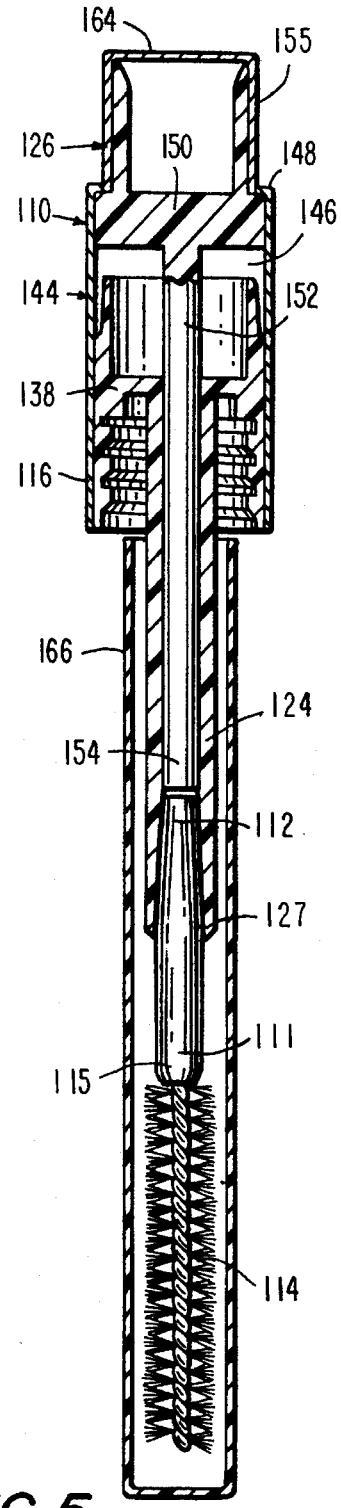
FIG. 5 is a longitudinal sectional view of a modified mascara applicator, also embodying the invention, with the elements assembled together.
Figure 6:
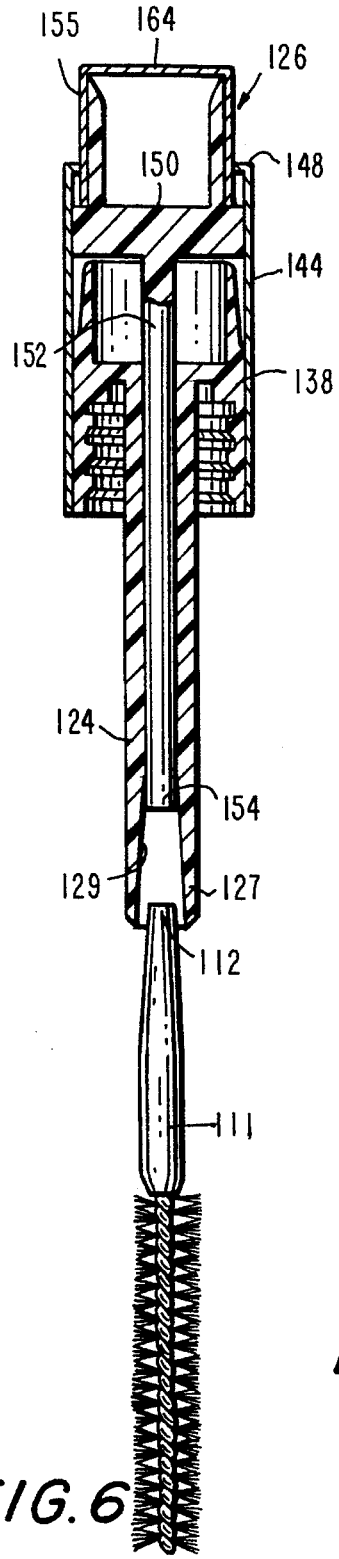
FIG. 6 is a similar view of the applicator of FIG. 5 showing the stem and head being ejected from the retaining means by the plunger means.
Figure 7:
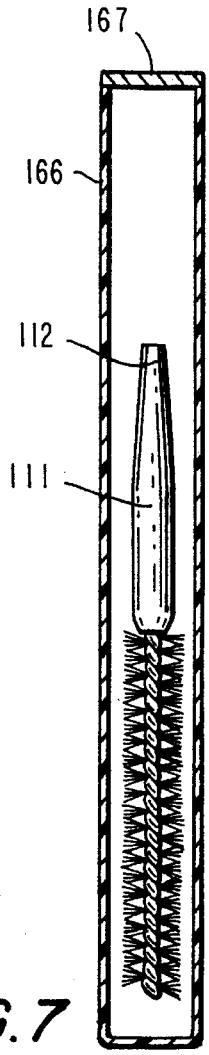
FIG. 7 is a similar view of the stem and head of the applicator of FIG. 5, enclosed in a shield, prior to assembly with the other elements of that applicator.

The modified embodiment of the mascara applicator of the invention shown in FIGS. 5–7, like that of FIGS. 1–4 and 8, includes a handle in the form of a container cap 110 with an internally threaded skirt 116 for seating on and closing the neck of a mascara container (such as the above-described container 20 shown in FIG. 8), an axially rectilinear rigid stem 111 having a proximal end portion 112 insertable in and ejectable from an open-ended retaining socket 124 carried by the cap, and an applicator head consisting of a conventional twisted-in-wire mascara brush 114 fixedly anchored in and extending from the distal end 115 of the stem, which projects substantially distally beyond the skirt so that the brush is exposed for pickup and application of mascara. A plunger element 126 carried by the cap is manually operable to eject the brush-carrying stem from the socket 124 for removal and replacement of the brush. Again, the elements of the applicator other than the brush can be fabricated of plastic and/or metal, molded or formed in known ways heretofore employed in the manufacture of mascara applicators.

More particularly, in the embodiment of FIGS. 5–7 the socket 124 is an elongated, substantially rigid, open-ended tubular (i.e., hollow) shaft extending through and distally beyond the skirt 115, coaxially therewith. The proximal end portion 112 of the stem 111 (which, in this embodiment, is relatively short) is inserted and held by friction fit within the distal end portion 127 of the elongated tubular socket or shaft 124. Both the distal end portion of the bore 129 of the shaft 124 and the proximal end portion 112 of stem 111 may be of circular cross-section and may taper slightly in the proximal direction.

The socket or shaft 124 is shown as molded or formed integrally with a plastic sleeve 138 constituting the body of the cap skirt 116 and bearing the internal thread that mates with the external thread of the container neck. A rigid outer sleeve 144, conveniently or preferably formed of metal and open at both ends, coaxially surrounds the socket-bearing sleeve 138 (being suitably bonded or adhered thereto) and extends for some distance proximally therefrom to define an interior space 146. At its upper or proximal end, sleeve 144 is turned inwardly around its entire periphery to provide an annular stop bead or flange 148.

The plunger element 126 in this embodiment includes a disk 150 confined but axially movable within the space 146 between the stop bead 148 and the socket-bearing sleeve 138; a plunger rod 152 formed integrally with the disk and projecting therefrom through the bore 129 of shaft or socket 124, and an exposed top portion 155 that projects proximally from the disk through and beyond the stop bead 148. The top portion may be covered with a metal jacket 164.

The plunger is movable between the first or proximal limiting position shown in FIG. 5 and the second or distal limiting position shown in FIG. 6. In each of these positions the distal end 154 of the plunger rod 152 is within and spaced proximally from the distal end of the shaft bore 129. When the plunger is in the first position, an inserted stem 111 is securely held by frictional engagement within the distal end portion of the shaft bore, as shown in FIG. 5. Movement of the plunger to the second position shown in FIG. 6, by application of manual (finger) pressure to the jacket 164, advances the distal end of the plunger rod along the bore 129 to engage and push the stem end 112 in a distal direction, ejecting the stem from the shaft. A new or different brush mounted on a similar stem can then be secured to the cap 110 by inserting its stem in the distal end of the shaft bore; if the plunger is in the second position, the stem simply pushes it back to the first position during such insertion.

As in the case of the first-described embodiment, and for the same purposes, the brush and stem may be enclosed in a shield 166 (FIG. 7), generally similar to the shield 66 of FIGS. 1, 3 and 4 but closed at its open end by a lid or seal 167 that is removed before use. The distal end of shaft 124 can be inserted into the open end of the shield to engage and receive the stem 111, which may be kept in a generally centered position within the shield by appropriate dimensioning of the shield relative to the brush. Once the stem has been fully inserted into the shaft by manual pressure exerted between the cap and shield, the shield can be slipped off the brush while the applicator is held by the cap.

It is to be understood that the invention is not limited to the features and embodiments hereinabove specifically set forth, but may be carried out in other ways without departure from its spirit.

What is claimed is:

1. A hand-held applicator for liquid material and pasty material, comprising:

(a) a handle dimensioned to be grasped by the fingers of a user's hand;

(b) a stem having a proximal end and a distal end, mountable in said handle such that the distal end extends therefrom; and (c) an applicator head carried by said stem at the distal end thereof;

wherein the improvement comprises:

(d) retaining means comprising an open-ended socket mounted in said handle for engaging a proximal end portion of said stem to releasably secure the stem to the handle, said proximal end portion being spaced a distance along said stem from said distal end and said proximal end portion and retaining means being mutually shaped and dimensioned to enable insertion of the proximal end of the stem into the retaining means and disengagement of the stem from the retaining means by force exerted on the proximal end of the stem in a direction toward the distal end of the stem; and (e) manually operable plunger means carried by the handle for engaging and exerting said force on the proximal end of said stem, when the proximal end of the stem is engaged by the retaining means, to eject the stem from the handle.

2. An applicator as defined in claim 1, wherein said plunger means is movable between a first position for accommodating engagement of the stem proximal end by the retaining means and a second position to which the plunger means is moved in ejecting the stem from the handle, said plunger means being movable from said second position to said first position by manual insertion of the stem proximal end into the retaining means and being movable from the first position to the second position by manual force exerted on the plunger means.

3. An applicator as defined in claim 2, wherein said handle is an internally threaded cap for seating on an externally threaded neck of a cosmetics container to close the container, said applicator head is a head for picking up, conveying and applying to a user's face a cosmetic material enclosed within the container, and at least the proximal portion of said stem is coaxial with the internally threaded cap.

4. An applicator as defined in claim 3, wherein said applicator head is a mascara brush.

5. An applicator as defined in claim 4, further including a removable shield enclosing said brush such that said brush may be preloaded with a sample quantity of the cosmetic material.

6. An applicator as defined in claim 3, wherein said cap comprises a skirt portion and said plunger means comprises a top portion of said cap, movable relative to said skirt portion in opposite directions axially of said skirt portion, and a plunger projection extending from said top portion into the interior of said cap coaxially therewith, said top portion and said skirt portion cooperating to limit movement of said plunger means relative to said skirt portion to translation between said first and second positions.

7. An applicator as defined in claim 6, wherein said stem proximal end has an annular circumferential groove and said retaining means comprises a resilient socket mounted within said cap and releasably engageable with said groove.

8. An applicator as defined in claim 6, wherein said retaining means comprises an open-ended tubular shaft, said plunger projection being inserted within said shaft, and said shaft having a distal end for receiving and frictionally engaging the proximal end portion of said stem.

9. A cosmetics dispenser comprising:

(a) a container for holding a quantity of a liquid cosmetic material and pasty cosmetic material, having an externally threaded neck;

(b) an applicator including (i) an internally threaded cap for seating on and closing said neck, said cap being dimensioned to be grasped by the fingers of a user's hand;

(ii) a stem having a proximal end and a distal end, mountable in said cap such that the distal end extends therefrom for insertion in the container when the cap is seated on the neck; and (iii) an applicator head carried by said stem at the distal end thereof;

wherein the improvement comprises:

(c) retaining means comprising an open-ended socket mounted in said cap for engaging a proximal end portion of said stem to releasably secure the stem to the handle, said proximal end portion being spaced a distance along said stem from said distal end and said proximal end portion and said stem being mutually shaped and dimensioned to enable insertion of the proximal end of the stem into the retaining means and disengagement of the stem from the retaining means by force exerted on the proximal end of the stem in a direction toward the distal end of the stem; and (d) manually operable plunger means carried by the handle for engaging and exerting said force on the proximal end of said stem, when the proximal end of the stem is engaged by the retaining means, to eject the stem from the handle.

10. A dispenser as defined in claim 9, wherein said container is a container for mascara and said applicator head is a mascara brush.

* * * * *